United States Patent [19]

Short, Jr. et al.

[11] Patent Number: 4,660,659

[45] **Date of Patent: * Apr. 28, 1987**

[54] DRAG TYPE DRILL BIT

[75] Inventors: Lot W. Short, Jr., Dallas, Tex.; John D. Barr, Cheltenham, England

[73] Assignee: NL Industries, Inc., New York, N.Y.

[ * ] Notice: The portion of the term of this patent subsequent to Sep. 3, 2002 has been disclaimed.

[21] Appl. No.: 763,031

[22] Filed: Aug. 6, 1985 (Under 37 CFR 1.47)

Related U.S. Application Data

[63] Continuation-in-part of Ser. No. 468,668, Feb. 22, 1983, Pat. No. 4,538,690.

[51] Int. Cl.[4] ..... E21B 10/46

[52] U.S. Cl. ..... 175/329; 175/410

[58] Field of Search ..... 175/329–330, 175/410, 374, 379; 76/101 A

[56] References Cited

U.S. PATENT DOCUMENTS

| | | | |
|---|---|---|---|
| 1,859,717 | 5/1932 | Rutrle | 175/410 |
| 2,966,949 | 1/1961 | Wepsala, Jr. | 175/329 |
| 3,239,275 | 3/1966 | Belugou | 175/410 |
| 3,575,247 | 4/1971 | Feenstra | 175/329 |
| 3,599,736 | 8/1971 | Thompson | 175/329 |
| 4,108,260 | 8/1978 | Bozarth | 175/410 X |
| 4,334,585 | 6/1982 | Upton | 175/329 |
| 4,538,690 | 9/1985 | Short, Jr. | 175/329 |
| 4,558,753 | 12/1985 | Barr | 175/329 |

*Primary Examiner*—Stephen J. Novosad
*Assistant Examiner*—Thuy M. Bui
*Attorney, Agent, or Firm*—Browning, Bushman, Zamecki & Anderson

[57] ABSTRACT

A drag-type drill bit comprises a bit body having an operating end face and a multiplicity of superhard cutting elements interlocked to the bit body. The cutting elements define a multiplicity of cutting areas dispersed over the operating end face of the bit body in a pattern adapted to cause the cutting areas to cut an earth formation to a desired three-dimensional profile as the bit body is rotated. The cutting areas have back rake angles which become more negative with distance from said profile.

23 Claims, 19 Drawing Figures

FIG. 1
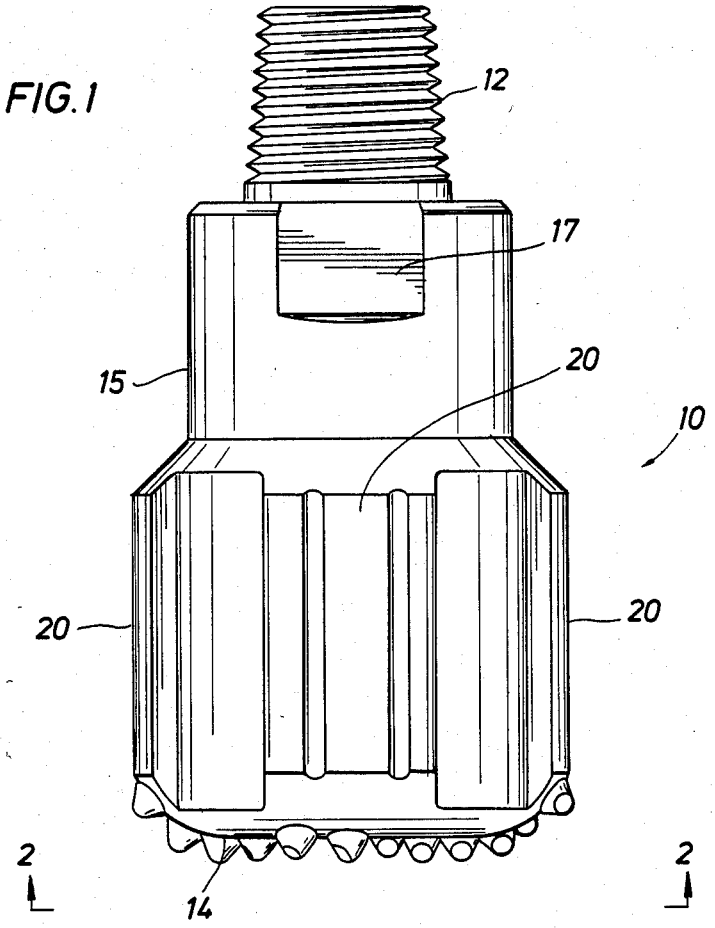
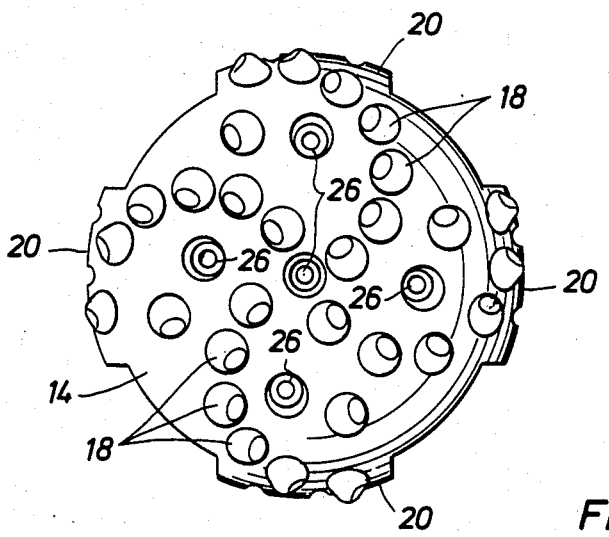
FIG. 2

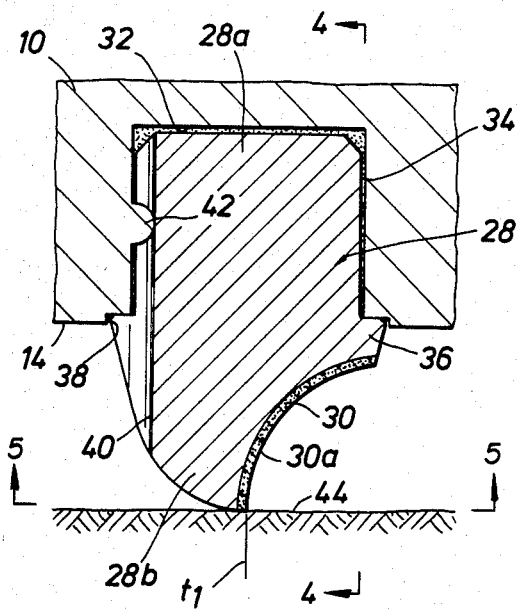
FIG. 3
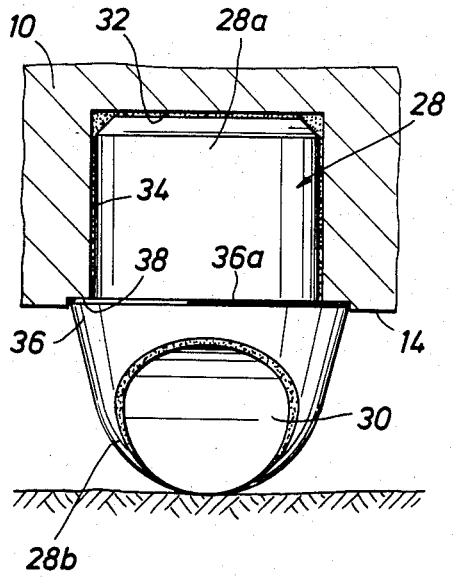
FIG. 4
FIG. 6
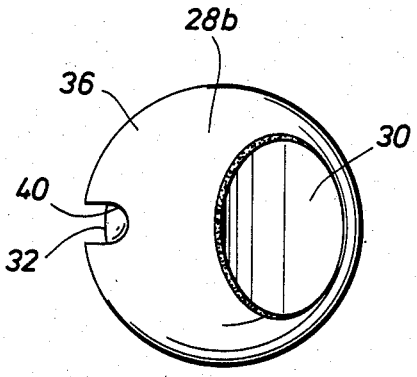
FIG. 5
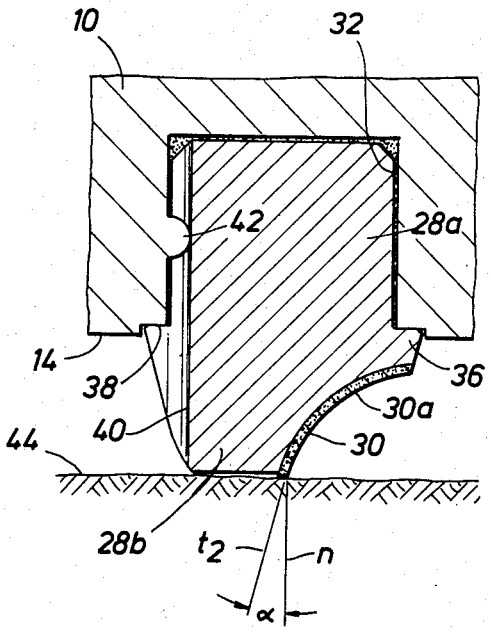

FIG. 9
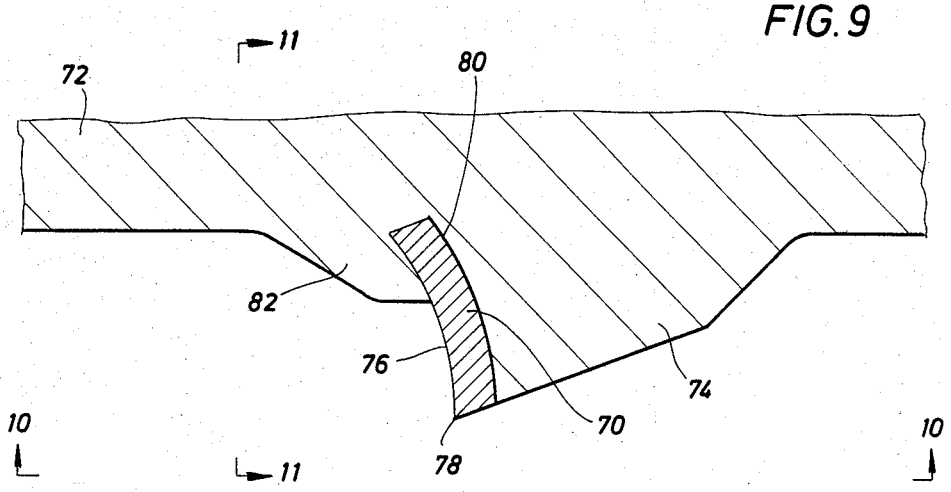
FIG. 10
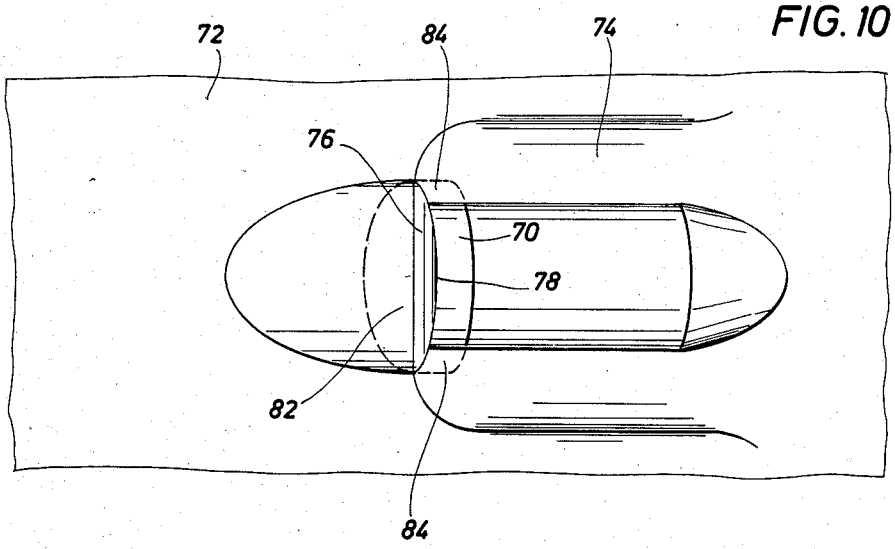
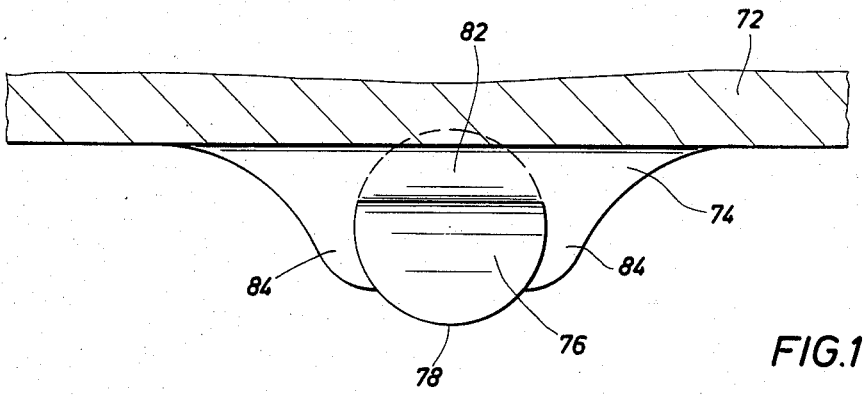
FIG. 11

FIG. 13
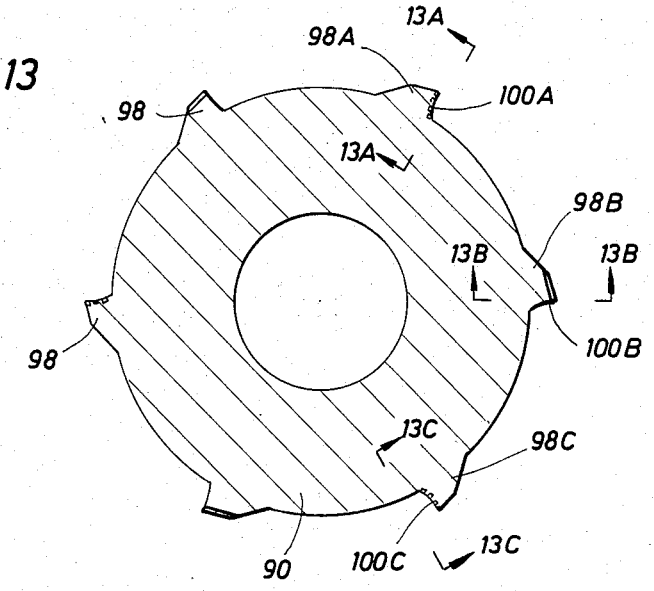
FIG. 13A
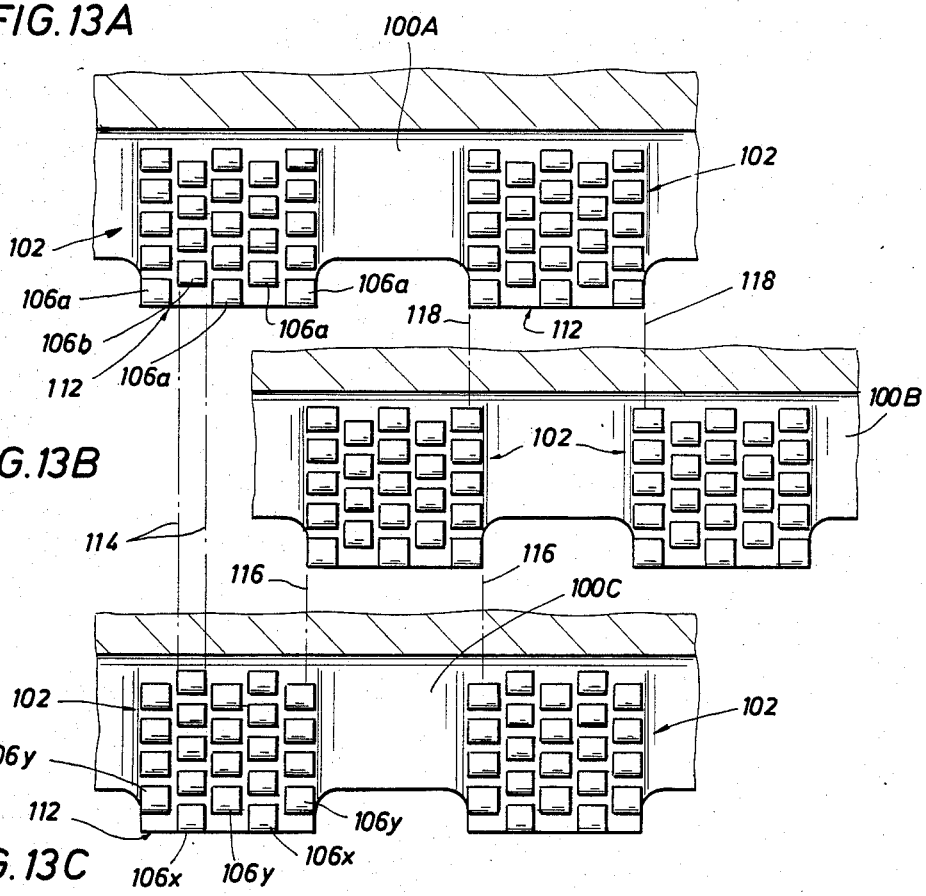
FIG. 13B
FIG. 13C

DRAG TYPE DRILL BIT

CROSS REFERENCE

This is a continuation-in-part application of U.S. patent application Ser. No. 468,668 filed Feb. 22, 1983 now U.S. Pat. No. 4,538,690.

BACKGROUND OF THE INVENTION

The present invention pertains to drag-type drill bits. In such a bit, a plurality of cutting members may be mounted on a bit body. Typically, each such cutting member comprises an elongate or stud-like body, e.g. of sintered tungsten carbide, carrying a layer of superhard material, e.g. polycrystalline diamond, which defines the actual cutting face. Such use of layers of different materials renders the cutting members self-sharpening in the sense that, in use, the tungsten carbide material will tend to wear more easily than the polycrystalline diamond material. This causes the development of a small step or clearance at the juncture of the two materials so that the earth formation continues to be contacted and cut substantially only by the edge of the diamond layer, the tungsten carbide substrate having little or no high pressure contact with the earth formation. Because the diamond layer is relatively thin, the edge thus maintained is correspondingly sharp.

The bit bodies in which these cutting members are mounted may generally be divided into two types: bodies formed of steel or similar ductile metallic material, and bodies formed of tungsten carbide matrix material. With steel body bits, it is relatively easy to mount the cutting members in the bit body by interference fitting techniques, e.g. press fitting or shrink fitting. In some instances, tungsten carbide matrix body bits are preferred over steel body bits because of their hardness. However, although harder than steel and similar metals, tungsten carbide matrix is also more brittle, rendering interference fitting techniques more difficult. Accordingly, in matrix body bits, the cutting members are often brazed into place.

A problem commonly associated with the use of such bits is that of selecting a suitable back rake angle for a particular drilling job. It has been found that the effectiveness of the cutting members and the bit in general can be improved by proper arrangement of the cutting members and, more specifically, their cutting faces, with respect to the body of the drill bit, and thus to the earth formation being cut. Conventional cutting faces are typically planar (although outwardly convex cutting faces are known). The cutting members can be mounted on the bit so that such planar cutting faces have some degree of side rake and/or back rake. Any given drill bit is designed to cut the earth formation to a desired three-dimensional "profile" which generally parallels the configuration of the operating end of the drill bit. "Side rake" can be technically defined as the complement of the angle between (1) a given cutting face and (2) a vector in the direction of motion of said cutting face in use, the angle being measured in a plane tangential to the earth formation profile at the closest adjacent point. As a practical matter, a cutting face has some degree of side rake if it is not aligned in a strictly radial direction with respect to the end face of the bit as a whole, but rather, has both radial and tangential components of direction. "Back rake" can be technically defined as the angle between (1) the cutting face and (2) the normal to the earth formation profile at the closest adjacent point, measured in a plane containing the direction of motion of the cutting member, e.g. a plane perpendicular to both the cutting face and the adjacent portion of the earth formation profile (assuming a side rake angle of 0°). If the aforementioned normal falls within the cutting member, then the back rake is negative; if the normal falls outside the cutting member, the back rake is positive. As a practical matter, back rake can be considered a canting of the cutting face with respect to the adjacent portion of the earth formation profile, i.e. "local profile," with the rake being negative if the cutting edge is the trailing edge of the overall cutting face in use and positive if the cutting edge is the leading edge. Substantial positive back rake angles have seldom, if ever, been used on the type of bit in question. Thus, in the terminology of the art, a negative back rake angle is often referred to as relatively "large" or "small" in the sense of its absolute value. For example, a back rake angle of −20° would be considered larger than a zero back rake angle, and a back rake angle of −30° would be considered still larger.

Proper selection of the back rake angle is particularly important for most efficient drilling in a given type of earth formation. In soft formations, relatively small cutting forces may be used so that cutter damage problems are minimized. It thus becomes possible, and indeed preferable, to utilize a very slight negative rake angle, a zero rake angle or even a slight positive rake angle, since such angles permit fast drilling and optimize specific energy. However, in hard rock, it is necessary to use a significant negative rake angle, in order to avoid excessive wear in the form of breakage or chipping of the cutting members due to the higher cutting forces which become necessary.

Problems arise in drilling through stratified formations in which the different strata vary in hardness, as well as in drilling through formations which, while substantially comprised of relatively soft material, contain "stringers" of hard rock. In the past, one of the most conservative approaches to this problem was to utilize a relatively large negative back rake angle, e.g. −20° for the entire drilling operation. This would ensure that, if or when hard rock was encountered, it would be drilled without damage to the cutting members. However, this approach is unacceptable, particularly where it is known that a substantial portion, specifically the uppermost portion, of the formation to be drilled is soft, because the substantial negative back rake angle unduly limits the speed of drilling in the soft formation.

Another approach, applicable where the formation is stratified, is to utilize a bit whose cutting members have relatively small or zero back rake angles to drill through the soft formation and then change bits and drill through the hard formation with a bit whose cutting members have substantial negative back rake angles, e.g. −20° or more. This approach is unsatisfactory because of the time and expense of a special "trip" of the drill string for the purpose of changing bits.

If it is believed that the formation is uniformly soft, a somewhat daring approach is to utilize the relatively small back rake angles in order to maximize the penetration rate. However, if a hard stringer is encountered, catastrophic failures can result. For example, severe chipping of only a single cutting member increases the load on neighboring cutting members and shortens their life resulting in a premature "ring out," i.e. a condition in which the bit is effectively inoperative.

Still another problem associated with the general type of bit and cutting member described above, is that chips of the formation material being drilled may build up ahead of the cutting faces of the cutting members.

SUMMARY OF THE INVENTION

The present invention comprises a drill bit including improved cutting elements, and which bit is designed to cooperate with the cutting elements in attacking various problems discussed above. A bit according to the present invention includes a bit body having an operating end face. A multiplicity of cutting elements are interlocked to the bit body, each of these cutting elements being comprised of a superhard material, preferably polycrystalline diamond material. The cutting elements define a multiplicity of cutting areas dispersed over the operating end face of the bit body in a pattern adapted to cause said cutting areas to cut an earth formation to a desired three-dimensional profile as the bit body is rotated.

The cutting areas have back rack angles which become more negative with distance from the earth formation profile. The terminology "more negative" and "less negative" is not meant to imply that all the back rake angles defined by the cutting areas are negative. Indeed, one of the advantages of the invention is that it makes the use of zero or slightly positive angles more feasible. Thus, the term "more negative" is simply intended to mean that the values of the angles vary in the negative direction (with distance from the earth formation profile) whether beginning with a positive, zero or negative value. Conversely, "less negative" will mean that the angles vary in the positive direction (e.g. with distance from the shank of the bit body).

In one embodiment of the invention, each of the cutting elements, more specifically the leading or cutting face thereof, defines a respective one of the cutting areas. In this embodiment, each individual cutting face is preferably curved, concave outwardly, so that it has a continuously changing back rake angle from its innermost to its outermost extremity. As the bit begins to operate, the outermost edges of the cutting faces present relatively small back rake angles to the formation, e.g. about 0°. Thus, assuming the bit was started in a relatively soft formation, it will be able to drill rapidly. If a hard stringer is encountered, or if the bit reaches the end of a soft stratum and begins to enter a hard stratum, the cutting edges will quickly chip or break away so that more and more negative rake angles will be presented to the earth formation. When the cutting elements have thus chipped away to a point where their back rake angles are suitable for the type of formation, such excessive wear or chipping will stop, and the bit can then continue drilling the formation essentially as if the back rake angle had initially been tailored to the particular type of rock encountered. Thus, the system may be considered self-adjusting in the negative direction. If, subsequently, soft formation is again encountered, the cutters can still continue drilling acceptably, albeit at a slower rate of speed than was possible in drilling the first soft formation.

Another advantage of the concave cutting faces is that, in the event of severe wear, the extreme negative back rake angle which will be presented to the formation will effectively stop bit penetration in time to prevent the formation of junk by massive destruction of the bit.

In the past, it has been conventional practice for cutting elements, in the form of thin layers of polycrystalline diamond material, to be pre-formed on a supporting post or substrate of sintered tungsten carbide. Typically, the bit bodies were pre-formed and the cutting members subsequently mounted therein by means of such posts or substrates. In the case of, for example, a steel bodied bit, it was simply easier to pre-form the bit body and then mount the posts of the cutting members therein by interference fitting techniques. In the case of tungsten carbide matrix bits, it would have ideally been preferable, in at least some cases, to mold the cutting members into the bit body as the latter was being formed by powder metallurgy techniques. However, this was not possible because the cutting members were not thermally stable at the temperatures necessary for formation of a tungsten carbide matrix bit body.

Due to recent advances in the technology for making polycrystalline diamond cutters, it is now possible to obtain polycrystalline diamond cutting elements which are thermally stable at temperatures typically used in the formation of matrix bit bodies, in the form of relatively thin wafers of polycrystalline diamond material, without the conventional tungsten carbide substrate.

It is therefore contemplated in accord with the present invention that such cutting elements may be mounted more or less directly to the bit body, without the use of a distinct post or the like. More specifically, each cutting element has a rear face opposite to its curved cutting face, and the bit body may be configured to underly and support a substantial portion of each such rear face. Even more specifically, a self-sharpening edge may be formed at the interface between each cutting element and the bit body. The cutting element may, for example, be mechanically interlocked with the bit body, by virtue of mating configurations of appropriate surfaces of the two. Alternatively, the cutting element may be chemically bonded to the bit body. As used herein, the term "interlocked" is intended to be broadly construed as covering either such manner of affixation as well as others. To an optimized lower limit, the thinner the polycrystalline diamond layer, the better the self-sharpening effect at the interface between that layer and the bit body. Thus, in order to make possible the use of relatively thin cutting elements, the bit body itself may incorporate various materials, using a material of higher modulus of elasticity in appropriate areas adjacent the rear face of the cutting element.

As mentioned, in the embodiment generally described just above, each cutting element defines a respective one of the cutting areas which are dispersed over the operating end face of the bit body. In another preferred embodiment, the cutting elements are arranged in a multiplicity of groups, each of the cutting areas being defined jointly by the cutting elements in a respective one of said groups. More specifically, each cutting area may be formed by a mosaic-like arrangement of very small cutting elements. Each of the cutting areas thus formed may, respectively, have a plurality of back rake angles. However, because the individual cutting elements are so very small, they may be formed with planar, rather than curved, leading or cutting faces. The variation in back rake angles over each respective area may then be achieved by varying the angles at which the individual cutting elements in a group are respectively mounted on the bit body. In general, such arrangement results in the same benefits and advantages as described above for the larger curved cutting elements.

In addition, the arrangement of the cutting areas on the bit body, and where mosaic-like patterns of small cutting elements are used to jointly define larger cutting areas, the arrangement of the cutting elements within each group, may involve staggering schemes which help to ensure relative uniformity of cutting action about a maximum portion of the earth profile being drilled.

While curved cutting elements could be mounted directly to steel bit bodies, as described above, in accord with the present invention, it is particularly advantageous to utilize such cutting elements with matrix bit bodies, because this permits the cutting elements to be, in essence, molded onto or into the bit body rather than applied to substrates to form cutting members and then mounting the cutting members in a pre-formed bit body. In particular, this saves time and expense by reducing the number of steps in the process, eliminates the need for accurately finished cutters, and eliminates the relatively easily erodable interfaces of braze material.

Accordingly, it is a principal object of the present invention to provide an improved drag-type drill bit.

Another object of the present invention is to provide such a bit in which a multiplicity of superhard cutting elements are interlocked to the bit body, the cutting areas defined by the cutting elements having back rake angles which become more negative with distance from the earth profile.

Still another object of the present invention is to provide such a bit wherein there is a self-sharpening edge at the interface between each cutting area and the bit body.

A further object of the present invention is to provide a multiple rake system of cutting elements of polycrystalline diamond in a bit body of tungsten carbide matrix.

Still other objects, features and advantages of the present invention will be made apparent by the following detailed description, the drawings and the claims.

BRIEF DESCRIPTION OF THE DRAWINGS

FIG. 1 is a side elevational view of a first embodiment of drill bit incorporating certain aspects of the present invention.

FIG. 2 is a bottom plan view of the bit of FIG. 1.

FIG. 3 is an enlarged detailed view showing one of the cutting members in side elevation and surrounding portions of the bit body in cross section, and taken in a plane in which back rake angle can be measured.

FIG. 4 is a view taken on the line 4—4 of FIG. 3.

FIG. 5 is a view taken on the line 5—5 of FIG. 3.

FIG. 6 is a view similar to that of FIG. 3 showing the cutting member after it has been chipped or worn to present a different back rake angle to the earth formation.

FIG. 9 is a view similar to that of FIG. 8 showing a third embodiment of the invention.

FIG. 10 is a view taken on the line 10—10 of FIG. 9.

FIG. 11 is a view taken on the line 11—11 of FIG. 9.

FIG. 13 is a diagrammatic transverse cross-sectional view generally on the line 13—13 of FIG. 12.

FIGS. 13A, 13B and 13C are enlarged detailed views of leading faces of successive blades on the bit, taken respectively on lines 13A, 13B and 13C of FIG. 13 and aligned by linear projections of circumferential lines about the operating end face of the bit.

DETAILED DESCRIPTION OF THE PREFERRED EMBODIMENT

Figure 7:
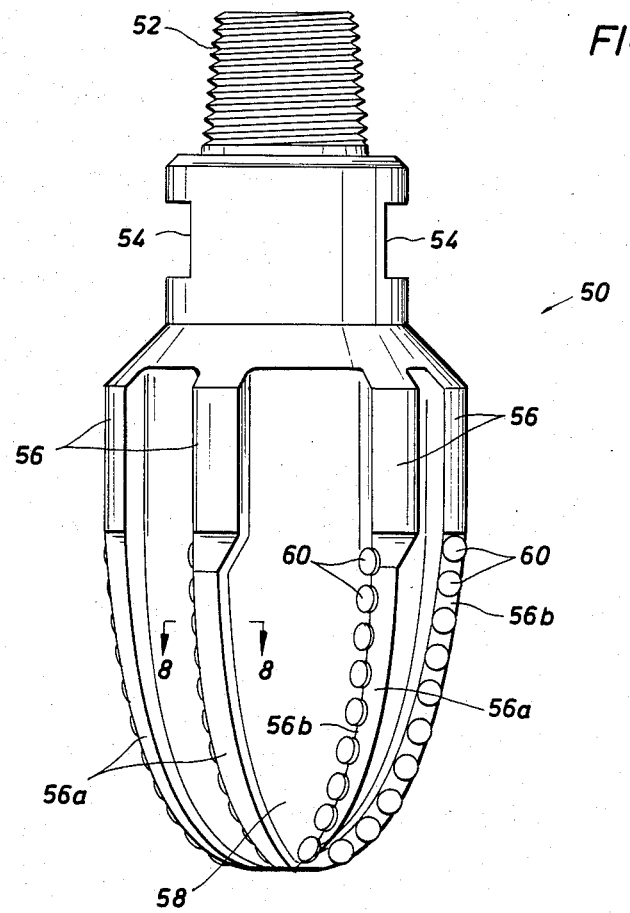
FIG. 7 is a side elevational view of a drill bit according to a second embodiment of the present invention.

FIGS. 1 and 2 depict a drill bit illustrating certain features of the present invention. As used herein, "drill bit" will be broadly construed as encompassing both full bore bits and coring bits. The bit body, generally designated by the numeral 10 is comprised of a tungsten carbide matrix material, although various aspects of the present invention are also applicable to bits formed of other materials such as steel. Bit body 10 has a threaded pin 12 at one end for connection to the drill string, and an operating end face 14 at the opposite end. The "operating end face," as used herein, includes not only the actual end or axially facing portion shown in FIG. 2, but contiguous areas extending partially up along the lower sides of the bit, i.e. the entire lower portion of the bit which carries the operative cutting members described hereinbelow. Just above the operating end face 14, bit 10 has a gauge or stabilizer section, including stabilizer ribs or kickers 20. Ribs 20, which may be provided with buttons of hard material such as tungsten carbide (not shown) contact the walls of the borehole which has been drilled by operating end face 14 to centralize and stabilize the bit and help control its vibration. Just above the gauge section is a smaller diameter section 15 having wrench flats 17 engaged while making up or breaking out the bit from the drill string. Operating end face 14 carries a plurality of cutting members or cutters 18. Referring to FIG. 2, the underside of the bit body 10 has a number of circulation ports or nozzles 26 through which drilling fluid is circulated in use.

Referring now to FIGS. 3-5, one of the cutting members and its relation to the adjacent portion of the bit body is shown in greater detail. The cutting member is comprised of an elongate post or stud-like body 28, also referred to herein as a "substrate," formed of sintered tungsten carbide, and a cutting element in the form of a layer 30 of superhard material, specifically polycrystalline diamond. As used herein, "superhard" will refer to materials significantly harder than silicon carbide, which has a Knoop hardness of 2470, i.e. to materials having a Knoop hardness greater than or equal to 2500. Body 28 includes an innermost shank or mounting portion **28*a* adjacent one end and a head or operating portion 28*b* adjacent the opposite end. Shank 28*a* is brazed into a bore 32 in bit body 10, the braze material being indicated at 34. When shank 28*a* is thus properly mounted, head 28*b* projects outwardly from the operating end face 14 of the bit body 10. Adjacent the juncture of mounting and operating portions 28*a* and 28*b*, operating portion 28*b* of the elongate body 28 has a lip or skirt formation 36 extending laterally outwardly with respect to shank 28***a* so as to overly the outer surface of the bit body around bore 32. More specifically, lip 36 defines a shoulder 36*a* immediately adjacent the juncture of portions 28*a* and 28*b* facing axially toward the inner end or shank end of body 28. Head or operating portion 28*b* is flared radially outwardly to the outer extremity of shoulder 36*a* as shown. The outer surface or, more specifically, the operating end face 14, of bit 10 may be provided with a shallow recess 38, as shown, for receipt of lip 36, although this is not strictly necessary.

It can be seen that lip 36 overlies the thin cylinder of braze material 34 and shields it from attack by the drilling fluid and entrained abrasives in use. This is of particular value in matrix body bits, wherein it is difficult to mount the cutting members with interference fits, and the braze material which may be used instead represents a relatively vulnerable area. As shown in FIGS. 3 and 5, body 28 has a lengthwise slot 40 which receives a detent 42 projecting inwardly from bore 32 in the bit body. The mating of slot 40 and detent 42 serves to index the cutting member to the proper orientation on the bit body, more specifically, so that layer 30 of polycrystalline diamond will be located on the leading side of the cutting member. Referring still of FIG. 5, it can be seen that lip 36 extends around the entire circumference of body 28, except in the area of slot 40. This break in lip 36 does not represent a substantial threat to the braze material 34 from the drilling fluid for two reasons: in the first place, slot 40 is very small and is located on the trailing side of the cutting member; secondly, projection 42 is so tightly received in slot 40 that it effectively forms a seal against ingress of the drilling fluid.

Because of the outward flaring of head 28*b* to the outer extremity of shoulder 36*a*, as described above, to form lip 36 generally in the form of a tapered skirt, that skirt forms, with the adjacent outer surface 14 of the bit body, an obtuse angle (neglecting the relatively thin side wall of recess 38). This helps to reduce turbulence in the drilling fluid around the cutting member, which in turn helps to retard erosion of both the bit body and the cutting member itself in that area.

As previously mentioned, head 28*b* of body 28 carried a relatively thin layer 30 of polycrystalline diamond which defines the cutting face 30*a* of the cutting member. Layer 30, the underlying portion of head 28*b*, and the cutting face 30*a* defined by layer 30 are all inwardly concave in planes in which their back rake angle may be measured, e.g. the plane of FIG. 3. Thus, cutting face 30*a* is a surface having a number of different back rake angles, which angles become more negative with distance from the profile of the earth formation 44, i.e. the angles become more negative from the outermost to the innermost edges of cutting face 30*a*, or less negative with distance from lip formation 36. (As used herein "distance" from the formation profile is measured from the closest point on that profile.) For example, as shown in FIG. 3, the original outermost edge of face 30*a* forms the initial cutting edge in use. It can be seen that a tangent $t_1$ to surface 30*a* at its point of contact with the earth formation 44 is substantially coincident with the normal to that surface at the same point. Thus, the back rake angle at the original outermost edge or cutting edge of surface 30*a* is 0°.

FIG. 6 illustrates the same cutting member after considerable wear. The step formed between head 28*b* of body 28 and layer 30 by the self-sharpening effect is shown exaggerated. It can be seen that, after such wear, the tangent $t_2$ to the cutting face 30*a* at its point of contact with the earth formation 44 forms an angle $\alpha$ with the normal n to the profile of the earth formation at that point of contact. It can also be seen that a projection of the normal n would fall within the cutting member 28, 30. Thus, a significant back rake angle is now presented to the earth formation, and because the normal n falls within the cutting member, that angle is negative. More specifically, the back rake angle $\alpha$ is about $-10°$ as shown.

In use, relatively soft formations may often be drilled first, with harder rock being encountered in lower strata and/or small "stringers." As drilling in such soft formation begins, the cutting member is presented to the earth formation in the configuration shown in FIG. 3. Thus, the operative portion of face 30*a* has a back rake angle of approximately 0°. With such a back rake angle, the bit can drill relatively rapidly through the soft formation without substantial or excessive wear of the cutting members. If and when harder rock is encountered, the cutting member, including both the superhard layer 30 and the body 28, will wear extremely rapidly until the back rake angle presented to the earth formation is a suitable one for the kind of rock being drilled. For example, the apparatus may rapidly chip away until it achieves the configuration shown in FIG. 6, at which time the wear rate will subside to an acceptable level for the particular type of rock. Thus, the cutting member, with its varying back rake angles, is self-adjusting in the negative direction.

Having reached a configuration such as that shown in FIG. 6 suitable for the local formation, the cutting member 18 and the other cutting members on the bit, which will have worn in a similar manner, will then continue drilling the new hard rock without further excessive wear or damage. If, subsequently, soft formation is again encountered, the cutting members, even though worn to the configuration of FIG. 6 for example, can still continue drilling. Although they will not be able to drill at the fast rate permitted by the original configuration of FIG. 3, they will at least have drilled the uppermost part of the formation at the maximum possible rate, and can still continue drilling the lower portion at a slower but nevertheless acceptable rate.

Thus, a bit according to the present invention will tend to optimize both drilling rate and bit life. The overall time for drilling a given well will be much less than if cutters with substantial negative back rake angles had been used continuously. At the same time, there will be no undue expense due to a special trip to change from one drill bit to another as different types of formations are encountered. Likewise, there will be no danger of catastrophic failure as if cutters with small or zero rake angles had been used throughout. It is noted, in particular, that if extreme wear is experienced, the surface 30*a* of the cutting member illustrated and the surfaces of the other similar cutting members on the bit will present such large negative back rake angles to the formation that bit penetration will be effectively stopped in time to prevent the formation of junk by massive damage.

The embodiment of FIGS. 1–6 may permit existing bit designs to be adapted for use of cutters having varying back rake angles with a minimum of modification. This aspect of the invention has been illustrated in connection with a typical bit in which the bores 32 are formed substantially perpendicular to the local bit profile. In order to provide for a back rake angle of 0° at the original or outermost edge of face 30*a*, given such orientation, face 30*a* is formed so that its outermost edge is tangent to a plane passing longitudinally through body 28. Further, for simplicity of manufacture, that plane contains the centerline of body 28, with the remainder of face 30*a* being laterally offset from the centerline as shown in FIG. 3. It should be understood, however, that the orientation of the cutting face with respect to the body on which it is carried can be changed to adapt the invention to other types of bits, in which the cutting members are not mounted at right angles to the local bit profile, and/or to provide for initial back rake angles of other than 0°.

The foregoing embodiment utilizes cutting members which, while differing from the prior art in terms of their configuration, are more or less conventional in terms of the materials employed therein, and in particular, in that the polycrystalline diamond cutting element or layer 30 is carried on a substrate in the form of body 28 of sintered tungsten carbide. In FIGS. 7–16, there are shown embodiments in which the present invention is associated with polycrystalline diamond cutting elements without tungsten carbide substrates. Pursuant to recent developments in the technology for making such cutters, these elements are thermally stable at temperatures typically utilized in the formation of matrix bit bodies by powder metallurgy techniques, more specifically, temperatures well over 750° C. and up to about 1200° C. Such thermally stable diamond materials are available from the General Electric Company under the tradename "GEOSET" or from DeBeers Industrial Diamond Division of Ascot, Berkshire, England, under the tradename "SYNDAX."

In accord with the present invention, such thermally stable cutting elements can be formed or arranged so as to provide varying back rake angles as described hereinabove, and a matrix bit body can be essentially molded onto or about such cutting elements by powder metallurgy techniques. The result is a bit whose cutting faces have varying back rake angles, becoming more negative with distance from the earth profile, with all the attendant advantages described above. A self-sharpening edge may be formed at the interface between each such cutting element and the bit body itself, rather than between the cutting element and an intermediate post or substrate.

Since the powder metallurgy techniques which would be used to mold the cutting elements into the bit body are generally well known, in the context of mounting natural diamonds in matrix bit bodies, they will not be described in detail herein. Suffice it to say that a mold designed to form a bit body of a desired configuration is provided, the cutting elements are pre-emplaced in the mold, and the mold is then packed with a powdered tungsten carbide material. Then, the tungsten carbide material is infiltrated with a metal alloy binder, such as a copper alloy, in a furnace so as to form a hard matrix.

Referring now to FIG. 7, there is shown an example of such a bit. The bit comprises a tungsten carbide matrix bit body, generally designated by the numeral 50. Bit body 50 has an uppermost threaded pin 52 for connection to the drill string, followed by a small diameter section with bit breaker slots 54, a large diameter stabilizer or gauge section with kickers or wear pads 56, and operating end face 58. Kickers 56 continue downwardly and radially inwardly across the operating end face as ribs 56*a*. Each rib 56*a* has a leading edge surface 56*b*, with reference to the direction of rotation of the bit in use. A plurality of cutting elements 60 according to the present invention are mounted in each rib 56*a* so that their cutting faces face generally outwardly along the respective leading edge surface 56*b*.

Figure 8:
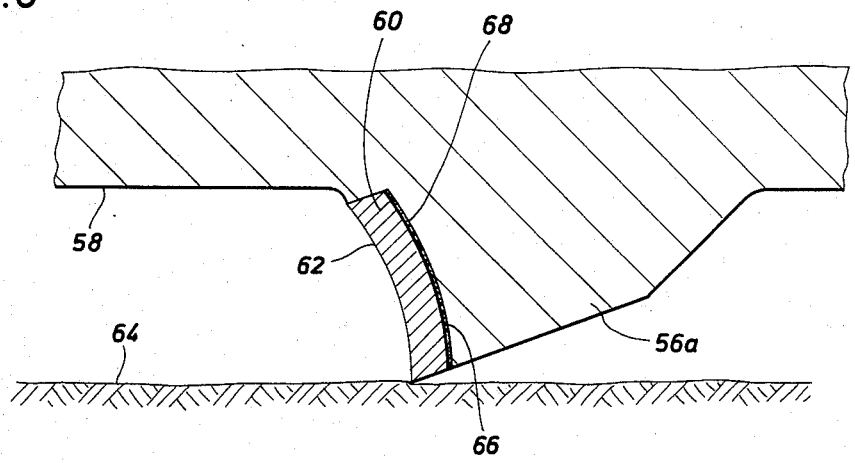
FIG. 8 is an enlarged detailed cross-sectional view through the center of one cutting element in a plane in which back rake angle can be measured, more specifically on the line 8—8 of FIG. 7.
Figure 12:
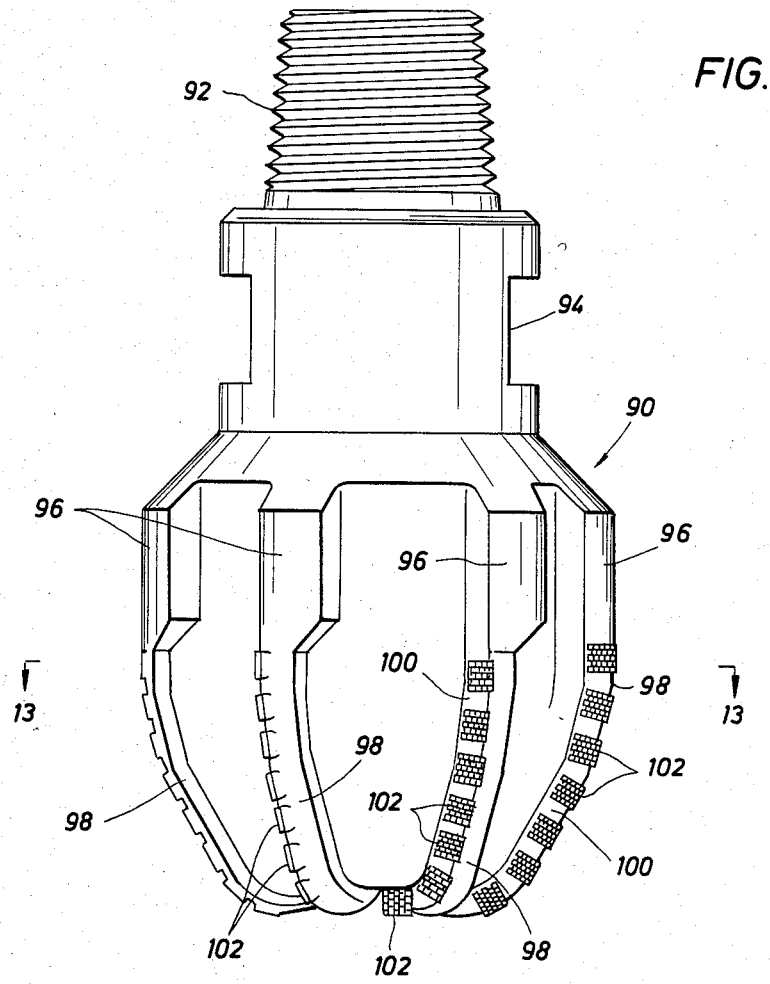
FIG. 12 is a side elevational view of a drill bit according to a fourth embodiment of the invention.

Referring now to FIG. 8 in conjunction with FIG. 7, one of the cutting elements 60, and adjacent portions of the bit body, are shown in greater detail. Cutting element 60 comprises a layer or wafer of polycrystalline diamond material which is thermally stable for the temperatures at which the bit body 50 is formed. Element 60 is molded into bit body 50 in the manner well known in the art and briefly summarized above. The cutting face 62, which as mentioned, faces generally outwardly along the leading edge surface 56*b* of rib 56*a*, is curved, concave outwardly, so as to define a cutting area having multiple back rake angles becoming more and more negative with distance from the earth profile 64.

The opposite side of element 60 from cutting face 62 will be referred to herein as the rear face 66. In order to firmly affix element 60 to the bit body, during formation of the latter, a thin layer of bonding material such as titanium or chromium or any other suitable material, shown greatly exaggerated at 68, is employed. For example, a thin layer of titanium may be pre-bonded to rear face 66 by vapor diffusion or sputtering, forming titanium carbide at the juncture. The composite is then emplaced in the mold followed by the powdered tungsten carbide material destined to form rib 56*a*. When the tungsten carbide material is infiltrated and heated, the binder alloy wets the titanium causing it to adhere to the underlying tungsten carbide matrix. Thus, layer 68 bonds element 60 to rib 56*a*, and such bonding will be referred to herein as an "interlocking," specifically a chemical type interlocking.

The material of rib 56*a* underlies and supports the rear face 66 of cutting element 60. Titanium layer 68 is so thin that, in effect, the material of rib 56*a* provides direct support for the cutting element 60.

It can further be appreciated that the material of the bit body immediately behind rear face 66 of cutting element 60, i.e. the titanium layer 68 and the tungsten carbide matrix material in rib 56*a*, will wear away more readily in use than the polycrystalline diamond material of element 60. Thus, a self-sharpening edge will be formed at the interface between element 60 and rib 56*a*. The thinner element 60 is in the front-to-rear (leading-to-trailing) direction, the greater the self-sharpening effect. Depending upon the materials employed in the bit body, particularly the materials utilized to form the underlying portion of rib 56*a*, element 60 could be made thinner than indicated in FIG. 8 for purposes of illustration.

Referring now to FIGS. 9–11, there is shown still another embodiment in which a cutting element 70 is affixed to a bit body 72 by a mechanical interlock and in which the supporting tungsten carbide matrix material to the rear of element 70 is in the form of an individual upset 74, rather than a continuous rib mounting multiple cutting elements. Each cutting element on the bit body 72 would be similarly supported by its own respective upset.

As mentioned, the cutting element 70 is identical to cutting element 60, and in particular, has a concave cutting face 76 terminating in a cutting edge 78. Cutting face 76 has a plurality of back rake angles which become increasingly negative with distance from the earth formation profile (not shown). Element 70 also has rear face 80 curved parallel to cutting face 76.

The mechanical interlock formations between the tungsten carbide matrix material of bit body 72 and the cutting element 70 includes a lip 82 of tungsten carbide matrix material which overlies the portion of cutting face 76 distal its cutting edge 78. The interlock formations further include bezel-like portions 84 of the bit body which circumferentially surround element 70 over more than 180° of its periphery. Due to the presence of lip 82, element 70 is retained against displacement from the bit body in the front-to-rear direction, and due to the presence of bezel-like structures 84, element 70 is retained against displacement in the direction toward the earth profile. These formations represent one form of mechanical interlocking of the cutting element 70 to the bit body.

It can be seen that, as in the preceding embodiment, the material of bit body 72, and more specifically the material in upset 74, underlies and supports the rear face 80 of element 70, and a self-sharpening edge is formed at the interface between the cutting element and the bit body, since the material adjacent the rear face 80 will wear away more quickly than the polycrystalline diamond material of element 70.

It can be seen that, in the embodiments of FIGS. 7–11, the superhard cutting elements 60, for example, interlocked to the bit body 50, define a multiplicity of cutting areas dispersed over the operating end face of the bit body in a pattern adapted to cause the cutting areas to cut an earth formation to a desired three dimensional profile, and that those cutting areas have back rake angles which become more negative with distance from such profile. In the embodiments of FIGS. 7–11, each of the cutting elements 60 or 70 defines a respective one of these cutting areas, and more specifically, the respective cutting area is generally defined by the leading or cutting face 62 or 76 of the cutting element. Furthermore, in the foregoing embodiments, each such cutting face itself has a plurality of back rake angles.

FIGS. 12–16 show additional embodiments which likewise comprise a multiplicity of superhard cutting elements interlocked to a bit body and defining a multiplicity of cutting areas dispersed over the operating end face of the bit body in a pattern adapted to cause these cutting areas to cut an earth formation to the desired profile, and in which the cutting areas have back rake angles which become more negative with distance from such profile. However, in the embodiments of FIGS. 12–16, each such cutting area is defined by a group of very small cutting elements arranged in what may be termed a "mosaic-like" array.

Furthermore, the leading faces or cutting faces of the individual cutting elements in these groups are, for convenience, planar. However, due to the fact that each cutting area is defined by a group of cutting elements, these planar cutting faces can be arranged so that each cutting area as a whole still has a plurality of back rake angles which become more negative with distance from the earth profile.

Referring specifically to FIGS. 12–15, there is shown a bit body 90 having an uppermost pin 92, a shank 94 with bit breaker slots, and a gauge section including wear pads 96, each of which is continuous with a rib 98 extending downwardly and radially inwardly over the operating end face of the bit body 90. Each of the ribs 98 has a leading edge surface 100 on which are mounted a plurality of groups 102 of cutting elements 104, each of the groups 102 defining a respective cutting area for the bit.

Figure 14:
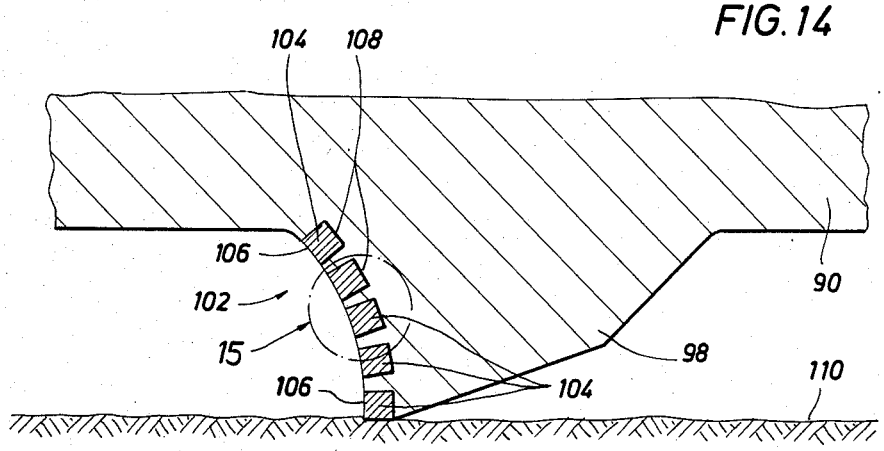
FIG. 14 is a view similar to that of FIG. 8 but of the embodiment of FIG. 12.

Referring more specifically to FIG. 14, the individual cutting elements 104 are in the form of thin rectangular blocks of polycrystalline diamond about which the tungsten carbide matrix material of the bit body 90 is formed and interlocked thereto in any suitable manner, e.g. by the chemical bonding technique described hereinabove in connection with FIG. 8. All faces of each element 104 are planar, including the leading or cutting faces 106 which face outwardly along the leading edge surfaces 100 of the respective ribs 98 and define the cutting areas of the bit. As in the embodiments of FIGS. 7–11, the rear face 108 of each cutting element 104 is completely backed and supported by the tungsten carbide matrix material of the respective bit rib 98.

As generally shown in FIG. 14, the various cutting elements 104 in a given group 102 are arranged at different angles with respect to the profile 110 of the earth formation being drilled. More specifically, the outermost elements, or those closest to the profile 110, are arranged so that their leading faces or cutting faces 106 are arranged at a back rake angle of approximately 0°. Cutting elements 104 farther and farther from profile 110 are arranged with their leading faces 106 at increasingly negative back rake angles. Thus, each cutting area defined by a respective group 102 of cutting elements 104 has a plurality of back rake angles as described hereinabove.

In each cutting area defined by a group 102 of cutting elements, those cutting elements closest to and engageable with the earth formation generally define a cutting edge 112 for the respective cutting area 102. Whereas, in the preceding embodiments, each cutting area was defined by a single relatively large cutting element, and thus had a continuous cutting edge, in the embodiments of FIGS. 12–16, the fact that each cutting area is defined by a mosaic-like group of cutting elements 104 dictates that the cutting edges 112 are interrupted; thus, the cutting edges 112 of the cutting areas 102 may be thought of as similar to a serrated blade.

(In the embodiment of FIGS. 12–15, a plain reference numeral, such as "98" or "106," may be used to refer generically to a type of element or structure, such as a rib or a cutting face, which occurs several times on a bit. Like numerals with postscripts, such as "98C" or "**106*a*," are used, where convenient, to distinguish between individual elements of the same general type. Thus, for example, the numeral "100" generally designates the leading edge surface of any rib of the bit body, while the numeral "100A" is used to identify one particular such leading edge surface and distinguish it from the next adjacent such surface "100B." Likewise, the numeral "106," generally designates a leading or cutting face of any one of the cutting elements 104, while "106*a*" is used to distinguish certain such cutting faces from other, such as "106*b***.")

As best shown in FIGS. 13A–13C, the cutting faces 106 of each group 102 of cutting elements 104 are arranged in parallel rows extending transverse to the respective cutting edge 112, and the cutting faces in adjacent rows are staggered, i.e. arranged in a brick-like array. Thus, referring for example to FIG. 13A, when the bit is new, the cutting edge 112 of each group 102 on the rib in question will be defined by the outermost cutting faces **106*a* in the first, third, and fifth rows of the group. As the bit wears, those cutting elements will eventually wear away and/or fall out, whereupon the outermost cutting faces 106***b* in the second and fourth rows of each group will take over the cutting function and the definition of the cutting edge. The staggered arrangement ensures that the cutting faces 106*b* in the second and fourth rows of each group will begin engaging the earth formation before the cutting faces 106*a* in the first, third, and fifth rows are completely gone. This ensures more continuous drilling. The process continues similarly as wear progresses inwardly over the cutting area 102.

The cutting faces 106 are staggered in two other ways. Referring jointly to FIGS. 13A, 13B and 13C, the leading edge surfaces 100A, 100B, and 100C of successive ribs 98A, 98B and 98C of the bit body 90 are shown aligned by linear projections of circumferential lines about the operating end face of the bit body. Examples of such linear projections of circumferential lines are shown at 114, 116 and 118; thus, for example, every point on line 114 is the same radial distance from the longitudinal centerline of the bit.

Thus, by comparing FIGS. 13A–13C, it can be seen that the cutting areas 102 of adjacent ribs leading surfaces 100A and 100B are staggered so that, generally speaking, there is a tendency in the bit as a whole to have at least one cutting area 102 actively drilling at any given radius across the operating end face of the bit body. This tends to maximize the surface area of the earth formation profile being drilled at any given time.

To further enhance this effect, as to those groups 102 of cutting elements 104 which are generally aligned with groups on other (non-adjacent) ribs of the bit body, e.g. the groups on rib surfaces 100A and 100C, the order of staggering of the cutting faces in individual groups 102 is reversed. For example, in the groups 102 of cutting faces operating from leading edge surface 100A of rib 98A, the initial cutting edge 112 is defined by, and thus the initial drilling is done by, those cutting faces 106*a* which lie outermost in the first, third, and fifth rows of each group 102. In an aligned group 102 of cutting faces 106 on operating edge surface 100C of rib 98C, the initial edge 112 is defined by, and the initial cutting is done by, faces 106*x* in the second and fourth rows which, as indicated by lines 114, are aligned with the interruptions in initial cutting edge 112 of the aligned group 102 on surface 100A. As cutting faces 106*x* wear away, and their cutting function is assumed by faces 106*y* in the first, third, and fifth rows of each group 102 on surface 100C, a similar transition will most likely be occurring as between faces 106*a* and 106*b* in each aligned group 102 on rib surface 100A.

Even further refinements are possible. For example, on other ribs, not shown in detail, each group of cutting element could be generally aligned with one or more of the groups in FIGS. 13A–C but slightly offset along the rib length so as to "cover" the small gaps between adjacent rows of cutting elements in the generally aligned groups of FIGS. 13A–C.

Figure 15:
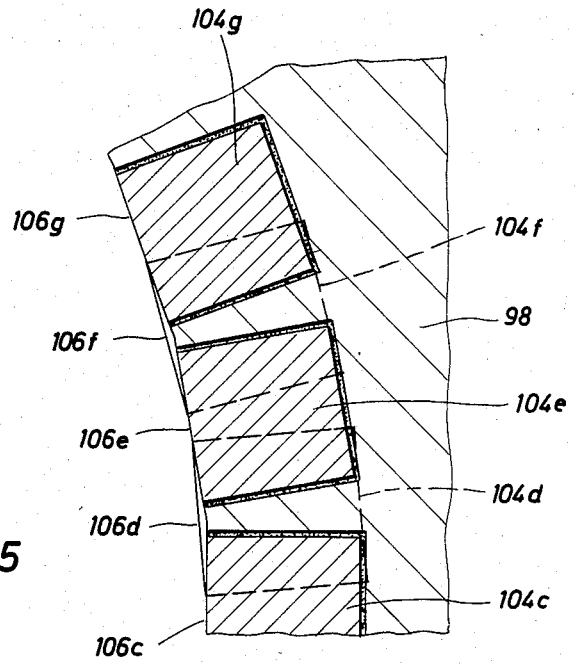
FIG. 15 is a further enlarged detailed view of the area encircled in FIG. 14.

Referring now to FIG. 15, it can be seen that the angles at which the various cutting elements 104 are disposed, and thus the back rake angles defined by their leading or cutting faces 106, are staggered generally to correspond with the staggering in distance from the earth profile of the various cutting elements. Thus, for example, the leading or cutting faces 106*c*, 106*e*, and 106*g* of cutting elements 104*c*, 104*e* and 104*g* in the third or center row of a group or array have back rake angles which become more negative with distance from the locus of the earth formation profile. A cutting element 104*d* located in the second row of the same group or array is positioned at a distance from the locus of the earth formation profile which is intermediate the comparable distances for elements 104*c* and 104*e* (i.e. staggered), and its cutting face 106*d* has a back rake angle intermediate those of faces 106*c* and 106*e*. Likewise, the back rake angle of face 106*f* is intermediate those of faces 106*e* and 106*g*.

Many, many other techniques for arranging small cutting elements in mosaic-like arrays to achieve the purposes of the invention are possible. For example, in the preceding embodiment, the elements in each group are arranged in parallel rows extending transverse to the cutting edge of the group, and the elements in adjacent rows of each group are staggered, as explained above. However, in other embodiments, rectangular elements could be arranged in staggered rows extending parallel to the cutting edge, so as to achieve less interruption in each individual cutting edge.

Figure 16:
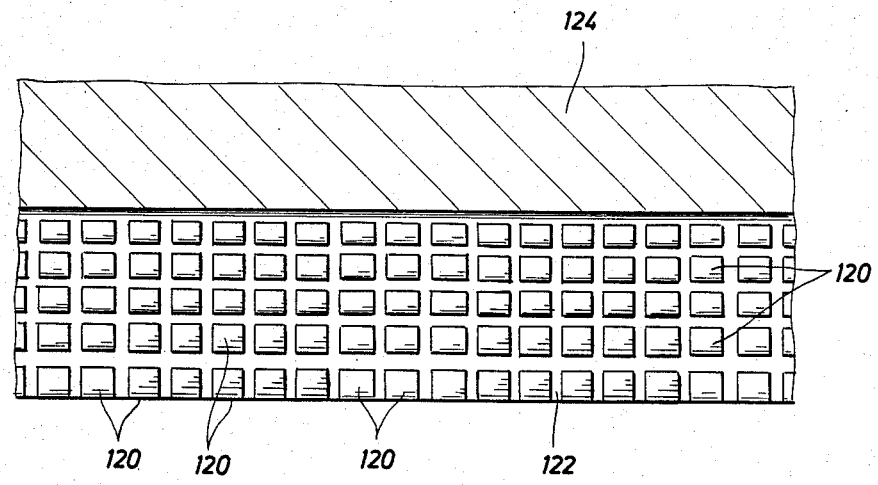
FIG. 16 is a view similar to that of FIG. 13A showing a fifth embodiment of the invention.

FIG. 16 illustrates another type of arrangement, using cutting elements in the form of thin rectangular blocks 120 similar to elements 104 of the preceding embodiment. The embodiment of FIG. 16 differs from the foregoing embodiment in two main respects. First, each group or array of cutting elements 102 extends over substantially the entire surface area of the leading edge surface 122 of a respective rib on the bit body 124. In other words, it might be said that the radially spaced groups of the preceding embodiment have been enlarged until they merge or become contiguous with one another along a blade. Secondly, the cutting elements in adjacent rows of the array illustrated in FIG. 16 are not staggered. It will be appreciated that many other arrangements are possible, particularly when it is considered that the cutting elements may take other forms, e.g. in which the leading or cutting faces thereof would not be rectangular, but rather in some other form, e.g. a hexagon, a triangle or a circle.

In all of the foregoing embodiments, each individual cutting area, whether define by a single cutting element, or a mosaic array of small cutting elements, has a plurality of back rake angles. In still other embodiments, it is possible for the cutting areas of the bit, as a whole, to have back rake angles which become more negative with distance from the earth formation profile, even though each individual cutting area is, for example, planar, and thus has a constant back rake angle.

Specifically, two sets of cutting areas could be provided, with cutting areas of the two sets being arranged generally alternately about the operating end face of the bit body. The first set of cutting areas would extend farther outwardly from the shank of the bit body than the second, so that only they would engage and drill the earth formation at the beginning of an operation. This first set of cutting areas could have back rake angles of, for example, 0°. The second set of cutting areas, which during initial drilling would be spaced inwardly from the earth formation profile, might have back rake angles of, for example, −20°. If, after some initial drilling, hard rock were encountered, the cutting areas of the first set would quickly break away, until the second set would begin to engage the earth formation. Thereafter, the second set of cutting areas would take over the drilling operation, operating at a more suitable rake angle for the hard rock being drilled. It will be apparent that this scheme could be further refined and sophisticated by using more than two sets of cutting areas, so that the back rake angles could vary over a wider range and/or in smaller increments.

Numerous other modifications of the preferred embodiments disclosed above will suggest themselves to those of skill in the art, and are within the spirit of the invention. It is thus intended that the scope of the invention be limited only by the claims which follow.

What is claimed is:

1. A drag-type drill bit comprising:
a bit body having an operating end face;
and a multiplicity of superhard cutting elements interlocked to said bit body, said cutting elements defining a multiplicity of cutting areas dispersed over said operating end face of said bit body in a pattern adapted to cause said cutting areas to cut an earth formation to a desired three-dimensional profile as said bit body is rotated, said cutting areas having back rake angles which become more negative with distance from said profile.

2. The apparatus of claim 1 wherein each of said cutting areas has, respectively, a plurality of back rake angles which become more negative with distance from said profile.

3. The apparatus of claim 2 wherein each of said cutting elements defines a respective one of said cutting areas.

4. The apparatus of claim 3 wherein each of said cutting areas defines a concave curve in the plane of measurement of said back rake angles.

5. The apparatus of claim 2 wherein each of said cutting elements has a rear face opposite said cutting area, and wherein said bit body is configured to underlie and support a substantial portion of each such rear face.

6. The apparatus of claim 5 wherein there is a respective self-sharpening edge at the interface between each such cutting element and said bit body.

7. The apparatus of claim 6 wherein each of said cutting areas defines a concave curve in the plane of measurement of said back rake angle.

8. The apparatus of claim 7 wherein each of said cutting elements is a wafer comprising polycrystalline diamond.

9. The apparatus of claim 8 wherein said bit body comprises a tungsten carbide matrix material.

10. The apparatus of claim 7 wherein each of said cutting areas defines a portion of a cylinder.

11. The apparatus of claim 3 wherein each of said cutting elements is a wafer comprising polycrystalline diamond, and wherein said bit body comprises a tungsten carbide matrix material.

12. The apparatus of claim 2 wherein said cutting elements are arranged in a multiplicity of groups, each of said cutting areas being defined jointly by the cutting elements in a respective one of said groups.

13. The apparatus of claim 12 wherein each of said cutting elements has a cutting face, and wherein the cutting faces of each such group are arranged in a mosaic-like pattern to define the respective cutting area.

14. The apparatus of claim 13 wherein the cutting faces of each such group are arranged in generally parallel rows, the cutting faces in adjacent rows of such group being staggered.

15. The apparatus of claim 14 wherein each of said groups generally defines a cutting edge for engaging such earth formation, and said rows of each such group extend transverse to said cutting edge.

16. The apparatus of claim 13 wherein each of said cutting elements has a rear face opposite said cutting face, and wherein said bit body is configured to underlie and support a substantial portion of each such rear face.

17. The apparatus of claim 12 wherein each of said cutting faces is generally planar.

18. The apparatus of claim 12 wherein the cutting elements of each of said groups define a self-sharpening edge at the interface with said bit body.

19. The apparatus of claim 12 wherein each of said cutting elements is a thin block comprising polycrystalline diamond.

20. The apparatus of claim 19 wherein said bit body comprises a tungsten carbide matrix material.

21. The apparatus of claim 20 wherein said bit body comprises a multiplicity of blades radiating across said operating end face and having respective leading surfaces with respect to an intended direction of rotation of such bit, said cutting elements being mounted on said blades with said cutting faces facing outwardly along said leading surfaces.

22. The apparatus of claim 21 wherein at least some of said blades have a plurality of distinct groups of said cutting elements thereon, and the groups of cutting elements on adjacent blades are staggered.

23. The apparatus of claim 22 wherein each of said blades has such a group of cutting elements thereon, extending along a major portion of the length of said blade.

* * * * *